US005078459A

United States Patent [19]

Sclater

[11] Patent Number: 5,078,459

[45] Date of Patent: Jan. 7, 1992

[54] BRACKET FOR A CAN DISPENSER

[75] Inventor: William C. Sclater, Cos Cob, Conn.

[73] Assignee: United States Tobacco Company, Greenwich, Conn.

[21] Appl. No.: 555,922

[22] Filed: Jul. 20, 1990

[51] Int. Cl.[5] ..... A47F 1/00

[52] U.S. Cl. ..... 312/45; 312/247; 211/59.2; 248/220.4

[58] Field of Search ..... 248/220.4, 221.1, 221.2, 248/302; 312/45, 72, 245, 246, 243; 211/59.1, 59.2, 47

[56] References Cited

U.S. PATENT DOCUMENTS 3,195,731 7/1965 Bomar ..... 248/303 X
3,489,382 1/1970 Larson ..... 248/221.1
3,985,324 10/1976 Larson ..... 248/221.1
4,287,992 9/1981 Takemori ..... 211/59.2
4,714,221 12/1987 Cawrey ..... 248/221.1

*Primary Examiner*—Joseph Falk
*Attorney, Agent, or Firm*—Fred A. Keire; Mary Ann Mullen

[57] ABSTRACT

A can dispenser bracket for use in a modular shelf display; each can dispenser bracket includes a recurvant guide for dispensing an individual can, planar side-end surfaces, an entrance opening, an exit opening, and a back-end surface having a metal bracket attached thereto. The can dispenser bracket may be mounted side-by-side in a modular shelf display which is particularly adapted to stores which have high shelf-space costs.

9 Claims, 4 Drawing Sheets

BRACKET FOR A CAN DISPENSER

BACKGROUND OF THE INVENTION

The invention relates to a bracket to hold a can dispenser on a pegboard type of vertical perforated store display; more particularly the invention relates to a bracket able to easily clip onto one edge of a vertical can dispenser to form a combination which is less costly to produce, stores more cans in less space, and which is able to deliver cans without jamming.

Retail stores have a limited amount of space in which to present the maximum number of goods to the retail customer. Thus, there is intense competition for shelf and hanging space in the retail store environment. Further, there is an intense competition for the space surrounding the checkout line, where the customers are gathered in one place and where the inducement to make a spontaneous purchase is at a maximum. Many typical retail convenience stores have pegboard type of perforated vertical surfaces arrayed around or behind the checkout counter, Thus, the design and placement of display racks and dispensers able to display, store and dispense the maximum number of retail goods, such as cylindrical cans, from the smallest volume, is of importance for maintaining successful retail sales.

DESCRIPTION OF THE PRIOR ART

Dispensers for cylindrical cans are known. One type of dispenser is a tube dispenser into which cans are stacked, consisting of a vertical metal cylinder with a dispenser slot at the bottom. These tube dispensers are at least as large in diameter as the can dispensed therefrom. Thus, a tube dispenser occupies a relatively large vertical area of valuable retail counter space, and the number of different types of cans which may be offered in a given vertical area and accompanying space is thereby limited. Another shortcoming of the tube dispenser is the propensity to jam when a stacked can shifts out of line within the dispenser tube. Yet another shortcoming of the tube dispenser is the cost of manufacture.

Thus, there is a long felt need in the art for a retail can dispenser which uses valuable retail shelf space more efficiently by being hung on a perforated vertical surface over the retail counter instead of being placed on the counter, which permits several different dispensers having different types of cans of different content to be easily dispensed from can holders arrayed side-by-side in a relatively compact space, which does not jam, and which is less costly to manufacture and if elevated, still provides a horizontal counter space.

SUMMARY OF THE INVENTION

The invention is broadly directed to a novel bracket for use in attaching a can dispenser to a store display shelf and to the combination of this novel bracket and a recurvate can dispenser.

The invention is also directed to a bracket able to removably hook to the top and bottom edges of the rear panel of a recurvate can dispenser, and which bracket is able to removably attach to a perforated vertical store display surface by means of top hooks and bottom pins.

In a further aspect, the invention relates to a bracket formed from two metal rods of equal length, with corresponding parallel hooks at each end of each rod for attaching to the top and bottom respectively of the back of a recurvant can dispenser, which rods are held in a parallel relationship by two brackets welded to the metal rods adjacent to the ends of the rods, where the bracket at the top end has two parallel hooks welded thereto for removably attaching to a perforated vertical surface, and the bracket at the bottom end has two parallel pins extending at right angles to the plane formed by the rods for removably attaching to a perforated vertical display surface so that the recurvate can dispenser is held vertically to a vertical display surface.

BRIEF DESCRIPTION OF THE DRAWINGS

With reference to the drawings which illustrate further the invention herein; these show an embodiment of same and wherein.

Figure 3:
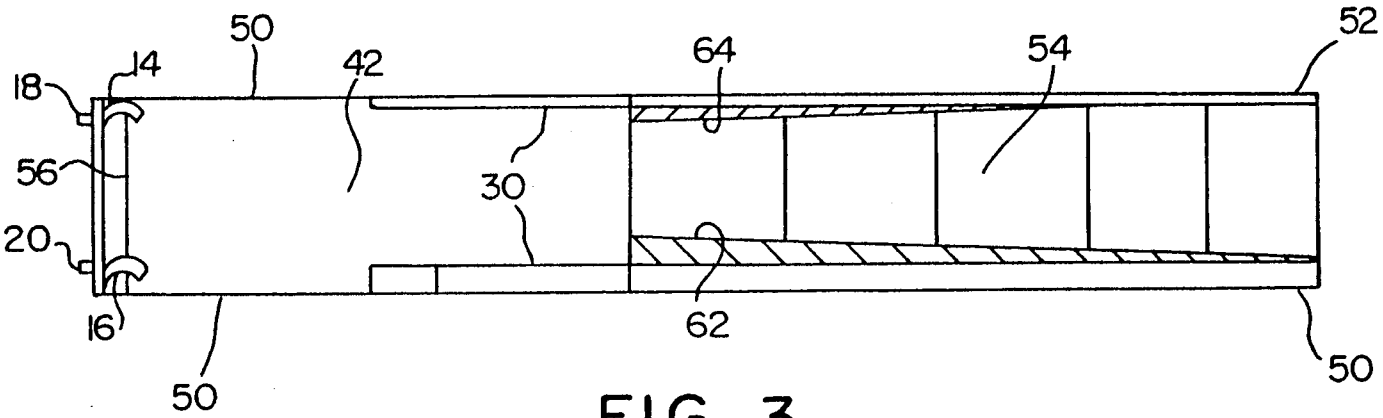
Figure 4:
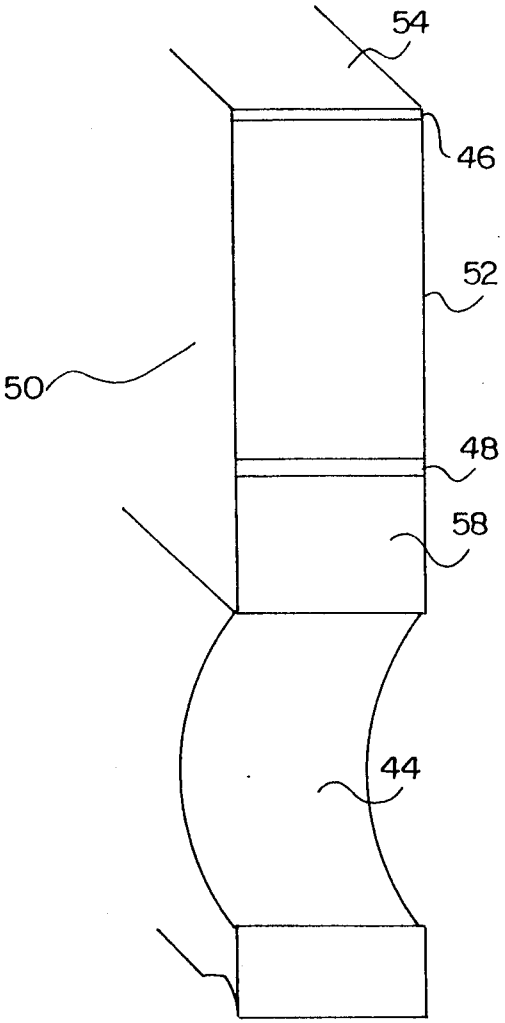

FIGS. *2a–2d* shows side and part perspective and part front view of both the top and bottom ends of the bracket;

FIG. 3 shows a top view of the can dispenser and bracket illustrating the slot into which cans are inserted; and FIG. 4 shows a front view of the can dispenser illustrating the opening through which cans are removed from the can dispenser.

DETAILED DESCRIPTION OF THE PREFERRED EMBODIMENT

The invention may be more clearly understood by referring to the figures. The bracket is formed of two parallel metal rods 8, 10 having parallel hooks on the upper 14, 16, and lower 22, 24 ends of the bracket so that the bracket is able to removably hook to the back panel 56 of the can dispenser. The distance between the top and bottom hooks is sufficiently longer than the vertical measurement of the back panel 56 of the can dispenser so that the bracket may be removably hooked to the can dispenser. This is accomplished by hooking the top hook over the top edge of the back panel and pulling the top hook tightly against the edge of the back panel to enable the second hook to pass over the bottom edge of the back panel and engage that bottom edge. When the assembled bracket and can dispenser ("modular shelf display apparatus") is hung on a vertical surface the bottom hook is pressed fully against the bottom edge of the back panel and the top hook is long enough (longer than the bottom hook) to prevent the top edge of the back panel from separating from the top hooks.

The metal rods 8, 10 are held in parallel by metal plates 12, 26 affixed to the metal rods adjacent to the top 12 and bottom 26 hooks. Welded or otherwise permanently attached to the top 12 metal plate are parallel "step-shaped" hooks 18, 20 able to insert into a perforated vertical surface or pegboard and hang in place without falling. Welded or otherwise permanently attached to the bottom 26 metal plate are pins 28, 30 which protrude at right angles from the metal plate and which are able to insert into a perforated vertical surface or pegboard and distribute a portion of the weight of the modular shelf display apparatus to the vertical surface. The bottom pins 28, 30 are held in the holes in the vertical surface by torque induced by the weight of the unbalanced modular shelf display apparatus hanging from the top "stair shaped" hooks 18, 20.

The can dispenser portion of the modular shelf display apparatus is preferably manufactured from plastic materials by injection molding techniques well known to the art. The use of this technique permits the production of a plastic can dispenser which is relatively inexpensive compared the prior art metal tube dispensers, and which is light enough and strong enough to join with the bracket to form the modular shelf display apparatus of the invention.

The operation of the can dispenser component of the modular shelf display apparatus may be more clearly understood by referring to the figures. A plurality of cans may be stacked in the can dispenser component by placing each can into the top of the dispenser until the dispenser is full. A can may be dropped directly into the opening at the top 42 or may be placed on the downward sloping guide 54 from which the can will roll into the opening 42.

Figure 1:
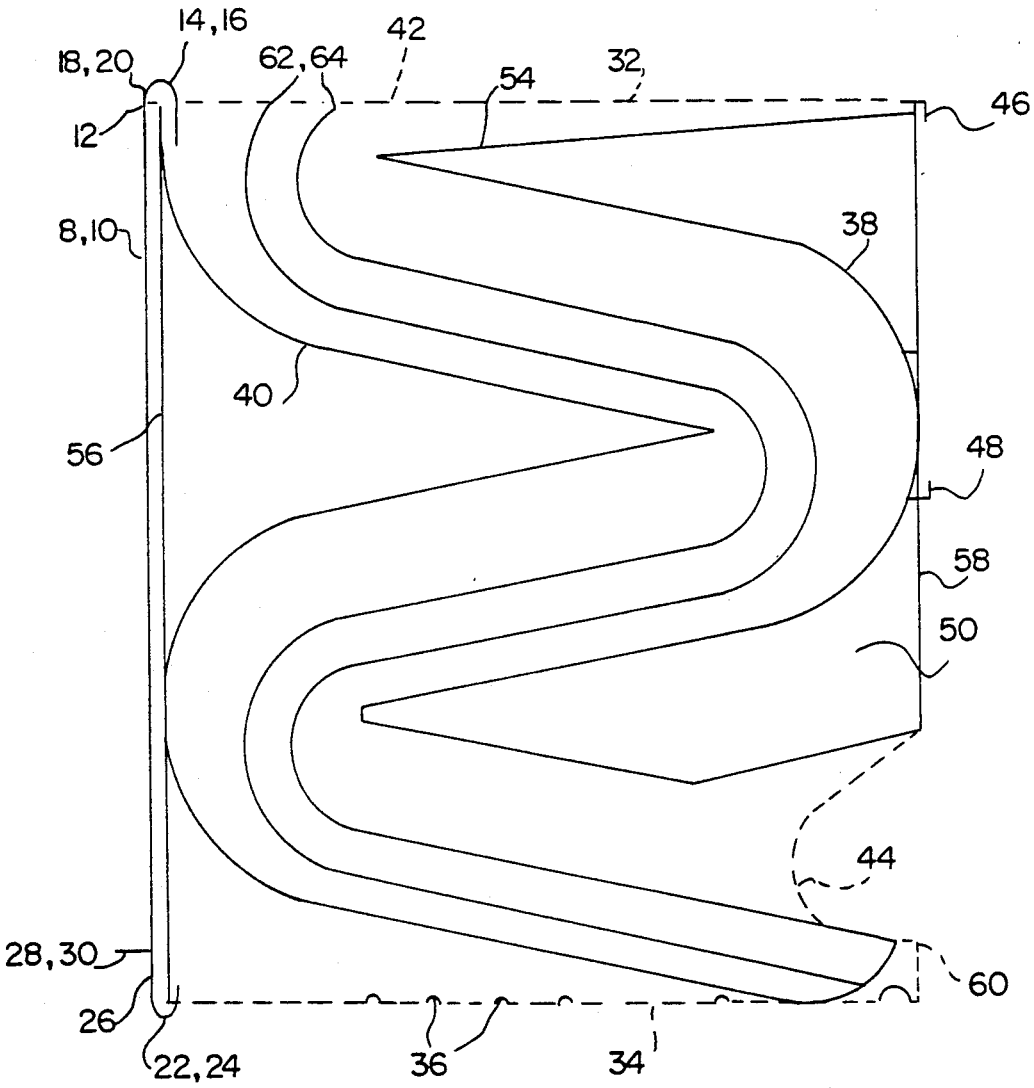
FIG. 1 shows a schematic side view of the can dispenser and bracket.
Figure 2A:
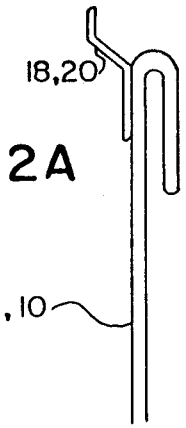
Figure 2B:
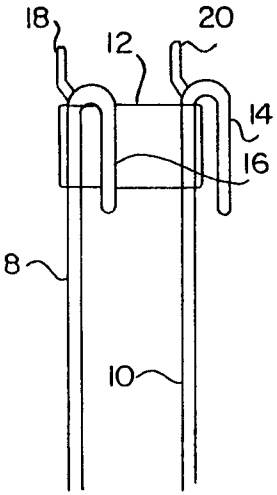
Figure 2C:
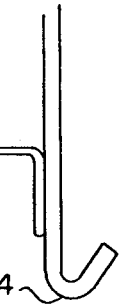
Figure 2D:
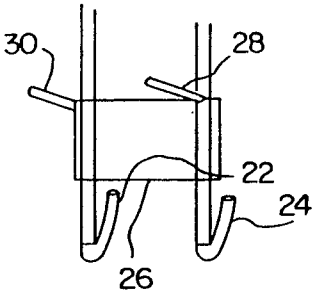

Once a can has entered the opening 42 it falls into an "S" shaped (FIG. 1) passage defined by a front recurvate guide 38, a rear recurvate guide 40 and by low friction front and rear positioned "S" shaped recurvate left and right side guards 62, 64. The recurvate guides each form an upper and lower portion of the passage at different portions of the "S" shaped passage. The recurvate side 62 and 64 guards are four (front and rear, left and right) thin strips of raised plastic which function to narrow the width of the passage to prevent cans from passing each other and jamming in the passage, but which present much less surface area, and thus create less friction, than would full side walls pressing against the cans as they pass.

The first can placed in the dispenser rolls downward until it reaches the bottom opening 44 where it rests against the raised lip 60 until removed. The additional cans stack up edge to edge in the passage behind the bottom can. When the bottom can is removed, all of the stacked cans roll down until the next can closest to the bottom comes to rest against the lip 60. Additional cans may be added at the top at any time.

Notches 36 in the bottom edges 34 of the side panels 50, 52 permit the dispenser to rest on a horizontal wire shelf to further stabilize the assembly if necessary.

A sign, card or other indicia of the contents of the dispenser may be usefully placed between the upper 46 and lower 48 flanges located on the on the front panel 58 of the dispenser. More than one assembly as described may be hung or stacked closely in a confined space so that a retail customer may select from among a number of types of product neatly displayed.

The advantage of having separate bracket and can dispenser components forming the combination of the modular shelf display apparatus is the convenience and economy of being able to replace one or the other component in the event of damage to one or the other component. A further advantage is that the dimensions of one or the other component may be economically modified in response to any future changes in the dimensions of retail display surfaces and adjacent areas in which it will be displayed, without necessarily changing the dimensions of both components of the modular shelf display apparatus.

The preferred embodiment is the combination of the bracket removably attached to the can dispenser to form the combination of the modular shelf display apparatus. The advantage of the modular shelf display apparatus is that it may be easily hung from any vertical perforated display surface and moved or replaced as needed as a unit. The modular shelf display apparatus is narrow in width (see FIG. 3 and FIG. 4), permitting multiple modules to be displayed side by side in a relatively small area.

What is claimed is:

1. A modular display apparatus for storing and dispensing a plurality of cylindrical cans which comprise a can dispenser and a bracket means in combination with said can dispenser for perpendicularly securing said can dispenser to a perforated vertical retail display surface, wherein said modular shelf display apparatus consists of:

front and rear serpentine guide means;

side faces perpendicularly adjoining said serpentine guide means forming an interior passage for storing the cylindrical cans, the side faces having at least one serpentine ridge between the serpentine guide means to prevent jamming of the cylindrical cans in the interior passage;

filling means for inserting the cylindrical cans including an inclined ramp for guiding the cylindrical cans into the serpentine guide means;

dispensing means for removing the cylindrical cans, said dispensing means including a retaining means for stopping the cylindrical cans at a position for removal;

rear support means perpendicularly joining the side faces; and removably attachable bracket means including upper and lower hook means for cooperation with the rear support means and upper and lower mounting means for removably mounting the can dispenser perpendicularly on the vertical retail display surface.

2. The modular display apparatus of claim 1 further comprising a top surface and wherein the rear support means contains an opening for filling the can dispenser.

3. The modular display apparatus of claim 1 wherein the serpentine guide means has a plurality of curves.

4. A modular display apparatus for storing and dispensing a plurality of cylindrical cans having a larger diameter than height comprising:

a recurvate guide having two parallel recurvate surfaces with left and right edges forming a path for the cylindrical cans;

planar side surfaces joined to the left and right edges of the parallel recurvate surfaces and forming an upper opening containing an inclined ramp for filling said recurvate guide;

a front surface having a lower opening containing a lip for restraining the cylindrical cans;

a rigid bottom surface joined to said planar side surfaces;

a rigid rear surface joined to said planar side surfaces;

a removably attachable mounting bracket for securing the rigid rear surface to a vertical retail display surface, said mounting bracket having two support rods of equal length, each having top and bottom ends, said top and bottom ends each terminating in upper and lower hooks for supportably attaching to the upper and lower edges of a rigid rear surface of the can dispenser; two upper mounts fixedly attached to the top ends of the two support rods having two parallel vertical lengths and one horizontal length joining the vertical lengths forming a step shape for removably fastening the top end of the support rods to the perforated vertical retail display surface; and two lower mounts fixedly attached to each of the two support rods at the bottom end of each support rod and extending at right angles to each support rod for removably fastening the bottom end of each support rod for a perforated vertical display surface.

5. The modular display apparatus of claim 4 wherein the rigid bottom surface contains notches to engage a wire shelf support.

6. The modular display apparatus of claim 4 wherein the front surface includes means for removably attaching a label identifying the goods dispensed by the display apparatus.

7. The modular display apparatus of claim 6 wherein the means for removably attaching a label consists of upper and lower edges fixedly attached to the front surface above the lower opening for slideably accepting a sign or label.

8. A bracket means for securing a can dispenser to a perforated vertical retail display surface comprising:

two support rods of equal length, each having top and bottom ends, said top and bottom ends each terminating in upper and lower hooks for supportably attaching to the upper and lower edges of a rigid rear surface of the can dispenser;

two upper mounts fixedly attached to the top ends of the two support rods having two parallel vertical lengths and one horizontal length joining the vertical lengths forming a step shape for removably fastening the top end of the support rods to the perforated vertical retail display surface; and two lower mounts fixedly attached to each of the two support rods at the bottom end of each support rod and extending at right angles to each support rod for removably fastening the bottom end of each support rod for a perforated vertical display surface.

9. The bracket for securing a can dispenser to a perforated vertical retail display surface of claim 8 wherein the upper hooks are longer than the lower hooks.

* * * * *